US011903464B2

(12) United States Patent
Luo

(10) Patent No.: US 11,903,464 B2
(45) Date of Patent: Feb. 20, 2024

(54) ELECTRICALLY-OPERATED UMBRELLA

(71) Applicant: Xiong Luo, Nantong (CN)

(72) Inventor: Xiong Luo, Nantong (CN)

( * ) Notice: Subject to any disclaimer, the term of this patent is extended or adjusted under 35 U.S.C. 154(b) by 134 days.

(21) Appl. No.: 17/755,476

(22) PCT Filed: Jan. 16, 2020

(86) PCT No.: PCT/CN2020/072344
§ 371 (c)(1),
(2) Date: Apr. 29, 2022

(87) PCT Pub. No.: WO2021/098036
PCT Pub. Date: May 27, 2021

(65) Prior Publication Data

US 2022/0369776 A1 Nov. 24, 2022

(30) Foreign Application Priority Data

Nov. 20, 2019 (CN) ..... 201911140073.X

(51) Int. Cl.
*A45B 25/16* (2006.01)
*A45B 25/14* (2006.01)
(Continued)

(52) U.S. Cl.
CPC ..... *A45B 25/165* (2013.01); *A45B 23/00* (2013.01); *A45B 25/006* (2013.01); *A45B 2025/146* (2013.01)

(58) Field of Classification Search
CPC ..... A45B 25/165; A45B 23/00; A45B 25/006; A45B 2025/146; A45B 25/143
(Continued)

(56) References Cited

U.S. PATENT DOCUMENTS 2,721,569 A * 10/1955 Militano ..... A45B 17/00 403/81
2,960,094 A * 11/1960 Small ..... A45B 25/14 135/37
(Continued)

FOREIGN PATENT DOCUMENTS

CN 201563783 U * 9/2010

OTHER PUBLICATIONS 4 page PDF of English translation of Cn 201563783-U to Tang. (Year: 2015).*
(Continued)

*Primary Examiner* — Robert Canfield
(74) *Attorney, Agent, or Firm* — Wang Law Firm, Inc.

(57) ABSTRACT

An electrically-operated umbrella comprises a column (1), an upper tray (2), a lower tray (3), a plurality of long rods (4) and short rods (5); one end of each short rod (5) is hinged to the lower tray (3), while the other end of each short rod (5) is hinged to each long rod (4); a housing (30) is attached to a lower portion of the column (1); a rotatable rope shaft (8), a motor (10) and a transmission mechanism are placed inside the housing (30); a rope (80) is disposed on the rope shaft (8); a battery (40) and a circuit board are further disposed inside the housing (30); two control buttons (17, 18) are disposed outside the housing (30). The present invention is rational and compact in structure, capable of electrically opening or folding the framework without manual operation, and low in cost.

8 Claims, 6 Drawing Sheets

(51) Int. Cl.
*A45B 23/00* (2006.01)
*A45B 25/00* (2006.01)

(58) Field of Classification Search
USPC ..... 135/20.3
See application file for complete search history.

(56) References Cited

U.S. PATENT DOCUMENTS 3,150,671 A * 9/1964 Frey ..... A45B 17/00 403/104
6,446,650 B1 * 9/2002 Ma ..... A45B 17/00 248/514
8,297,294 B2 * 10/2012 Li ..... A45B 3/04 248/316.4
8,757,183 B2 * 6/2014 Volin ..... A45B 25/143 135/25.4
9,265,312 B2 * 2/2016 Chow ..... A45B 3/02
9,968,168 B2 * 5/2018 Ma ..... A45B 3/02
10,064,465 B2 * 9/2018 Pan ..... A45B 25/14
10,519,713 B2 * 12/2019 Holt ..... E06B 9/50
2005/0016571 A1 * 1/2005 Wu ..... A45B 25/165 135/20.1
2005/0133077 A1 * 6/2005 Zerillo ..... A45B 25/143 135/20.3
2005/0247332 A1 * 11/2005 Hung ..... A45B 25/165 135/20.3
2014/0096802 A1 * 4/2014 Volin ..... A45B 25/143 135/16
2019/0047372 A1 * 2/2019 Schroeder ..... G01K 7/427
2019/0236988 A1 * 8/2019 Lin ..... G09F 9/301
2019/0242448 A1 * 8/2019 Ross ..... B60T 13/746
2020/0305774 A1 * 10/2020 Cremerius ..... A61B 5/6829

OTHER PUBLICATIONS 3 page PDF of English translation of the written opinion dated Jun. 30, 2020 in PCT/CN2020/072344. (Year: 2020).*

* cited by examiner

ELECTRICALLY-OPERATED UMBRELLA

TECHNICAL FIELD OF THE INVENTION

The present invention relates to an umbrella and in particular to an electrically-operated umbrella.

BACKGROUND OF THE INVENTION

As a kind of outdoor leisure items, parasols are widely applied in squares, beaches, parks, gardens or similar places to shield an individual from sun. The structure for the existing umbrellas is generally composed of a pole, an umbrella frame and a canopy, wherein the umbrella frame is connected to the top of the pole, the pole mainly plays a role in supporting the umbrella frame, and the canopy is connected to the umbrella frame. When the umbrella frame is unfolded, the canopy is also unfolded, so that the umbrella is opened. Umbrellas need to have different shading areas in different application scenarios. Large umbrellas used outdoors are generally very large and high, and are usually operated by a push member, a pull rope, a handle or the like.

The umbrellas in the prior art have some deficiencies. When the umbrella is large in area, the tubes forming the rods and middle sections of the structure are relatively long. When a push member or a pull rope is used, in order to satisfy the user's requirements of operation height, it is necessary to lengthen some tubes, resulting in waste and cumbersome operation. When a handle is used, due to the limitation of the length of tubes, the umbrella can be opened or folded by rotating the handle for multiple times, so it is time-consuming, labor-consuming, inefficient and inconvenient to use. With the improvement of the living standard, easily-operated umbrellas become a development trend of umbrellas in the future.

Upon examination, the existing Chinese Patent 201520724492.9 disclosed an umbrella electrically operated using solar energy, comprising an umbrella body, wherein the umbrella body is composed of a pole, rods connected to the handle and a canopy covered on the rods; a folding/unfolding mechanism for controlling the rods to be folded or unfolded is disposed inside the pole; a control box is disposed on the top of the pole, and a main control board is disposed in the control box; the umbrella further comprises a wind speed detection unit detachably assembled on one side of the control box; and, a detected signal of the wind speed detection unit is transmitted to a control module on the main control board. This umbrella is powered by solar energy and can determine, according to the output current of the solar panel, whether it is in the daytime or at night so as to open the umbrella body in the daytime and fold the umbrella body at night. The fully automatic operation is very convenient, but the cost is high and it is difficult to popularize. Although it is disclosed that the umbrella has a folding/unfolding mechanism, the specific structure of the folding/unfolding mechanism is not described.

SUMMARY OF THE INVENTION

It is an object of the present invention to provide an electrically-operated umbrella which is rational in structure, free of manual operation and low in cost.

For achieving the above object, the electrically-operated umbrella comprises a column being hollow; an upper tray attached to top of the column; a lower tray slidably fitted onto the column; a plurality of long rods movably connected to the upper tray; a plurality of short rods movably connected to the lower tray; and a rope extending inside the column; wherein, the lower tray is capable of sliding upward and downward along the column; each long rod is rotatably hinged to the upper tray, and one end of each short rod is hinged to the lower tray, while the other end of each short rod is hinged to each long rod, forming an umbrella frame; a housing is attached to a lower portion of the column; a rotatable rope shaft, a motor for rotating the rope shaft, and a transmission mechanism are placed inside the housing; the rope shaft is traversely disposed across the column through a plurality of fixation seats; one end of the rope is connected to the rope shaft, and the other end of the rope runs upward through the upper tray inside the column and then runs downwardly to connect to the lower tray; a battery and a circuit board are further disposed inside the housing, and a control button connected to the circuit board is disposed on the housing to form a control circuit of the motor.

Preferably, a through hole for receiving the rope shaft is radially disposed in the lower portion of the column; the plurality of fixation seats are composed of a left fixation seat and a right fixation seat, which symmetrically disposed on left and right sides of the column, a plurality of connecting holes are formed on upper and lower sides of the fixation seats, and the plurality of fixation seats are fixed to the middle column through a plurality of connecting members; a circular hole for receiving the left end of the rope shaft is formed in the middle of the left fixation seat, and a shaft seat for fixing and rotating the right end of the rope shaft is formed in the middle of the right fixation seat; and the right end of the rope shaft passes through the column to be inserted into the shaft seat of the right fixation seat, while the left end of the rope shaft passes through the middle column to be inserted into the circular hole of the left fixation seat and is connected to the transmission mechanism.

Preferably, the transmission mechanism comprises a transmission box, and a planetary gear set, a large spur gear and a small spur gear disposed in the transmission box; the transmission box comprises a transmission box seat and a transmission box cover; the transmission box seat is disposed on the left side of the left fixation seat, one end of the transmission box seat is fixed to the left fixation seat, and a mounting cylinder for receiving the planetary gear set is convexly disposed at the other end of the transmission box seat; the transmission box cover is disposed at a right opening of the mounting cylinder of the transmission box seat; the motor is fixedly mounted on the transmission box cover, and a motor shaft passes through the transmission box cover and is connected to the planetary gear set; and the other end of the planetary gear set is connected to the small spur gear through an output shaft.

Preferably, the large spur gear and the small spur gear are respectively disposed on the left side of the transmission box seat, and the large spur gear is meshed with the small spur gear; the output shaft is disposed at a position on the transmission box seat at the left opening of the mounting cylinder; a second circular hole corresponding to the circular hole in the middle of the left fixation seat is formed on the transmission box seat, and a driven shaft is disposed in the second circular hole; and one end of the driven shaft is connected to the large spur gear, and the other end thereof passes through the transmission box seat and is in transmission connection to the left end of the rope shaft through a reverse clutch.

Preferably, a convex ring is formed at a position on the left side of the left fixation seat corresponding to the circular hole in the middle, the reverse clutch is disposed in the convex ring, the left end of the rope shaft is formed as a square shaft end, and a corresponding square hole is formed in the center of the reverse clutch.

Preferably, a hexagonal groove convenient for manually opening or folding the umbrella is disposed at the left end of the driven shaft, and an opening corresponding to the hexagonal groove is disposed on the corresponding side of the housing.

Preferably, a positioning slot for receiving the battery is disposed on the right side of the housing, the battery is a rechargeable battery and is detachably inserted into the housing, and a USB interface is further disposed on the housing.

Preferably, there are two control buttons, respectively an opening button and a folding button, and the opening or folding of the umbrella is capable of being controlled by the control buttons or by a remote controller.

Preferably, a sensor electrically connected to the circuit board is disposed on the housing; when the framework is folded to the bottom end and the sensor detects the rods during folding, the circuit board stops supplying power and realizes automatic stopping after the umbrella is folded; and when the framework is completely opened, the resistance of the motor by the rope is increased, and the current in the motor is increased, and the circuit board automatically stops supplying power after detecting the current and realizes automatic stopping after the umbrella is opened.

Finally, an automatic bending mechanism is additionally mounted on the middle column; the rope passes through the automatic bending mechanism and is connected to the lower tray; and when the rotation of the rope shaft drives the lower tray to move up to the top, the rope shaft is continuously rotated to drive the automatic bending mechanism to bend.

Compared with prior art, the present invention has the following advantages. By providing the rope shaft on the middle column and driving the rope shaft to rotate by the motor and the transmission mechanism, the rope is wound or loosen around the rope shaft, and the rope pulls the lower tray to move up and down along the middle column, so that the umbrella is electrically opened or folded. In addition, after the framework is opened and positioned, power can be cut off automatically. By providing the sensor, after the framework is folded, power can be cut off automatically to stop rotation. Moreover, by providing the USB interface, power can be supplied to a mobile device. The present invention is rational and compact in structure, capable of electrically opening or folding the framework without manual operation, convenient and quick to use and low in cost and greatly improves the user's use experience, so it is worth popularizing.

DETAILED DESCRIPTION OF THE INVENTION

Figure 1:
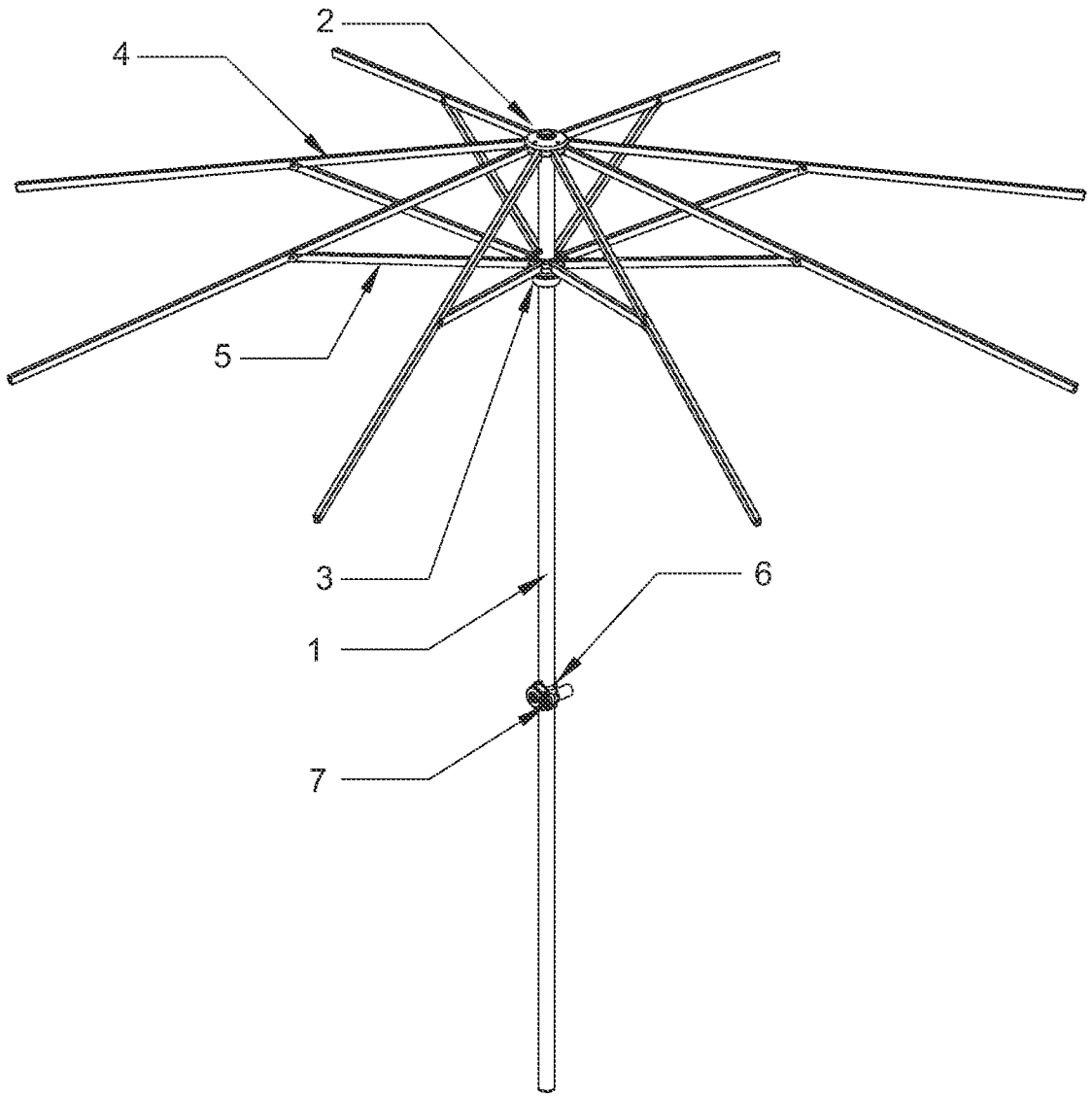
FIG. 1 is a perspective view of an electrically-operated umbrella according to Embodiment 1 of the present invention.
Figure 2:
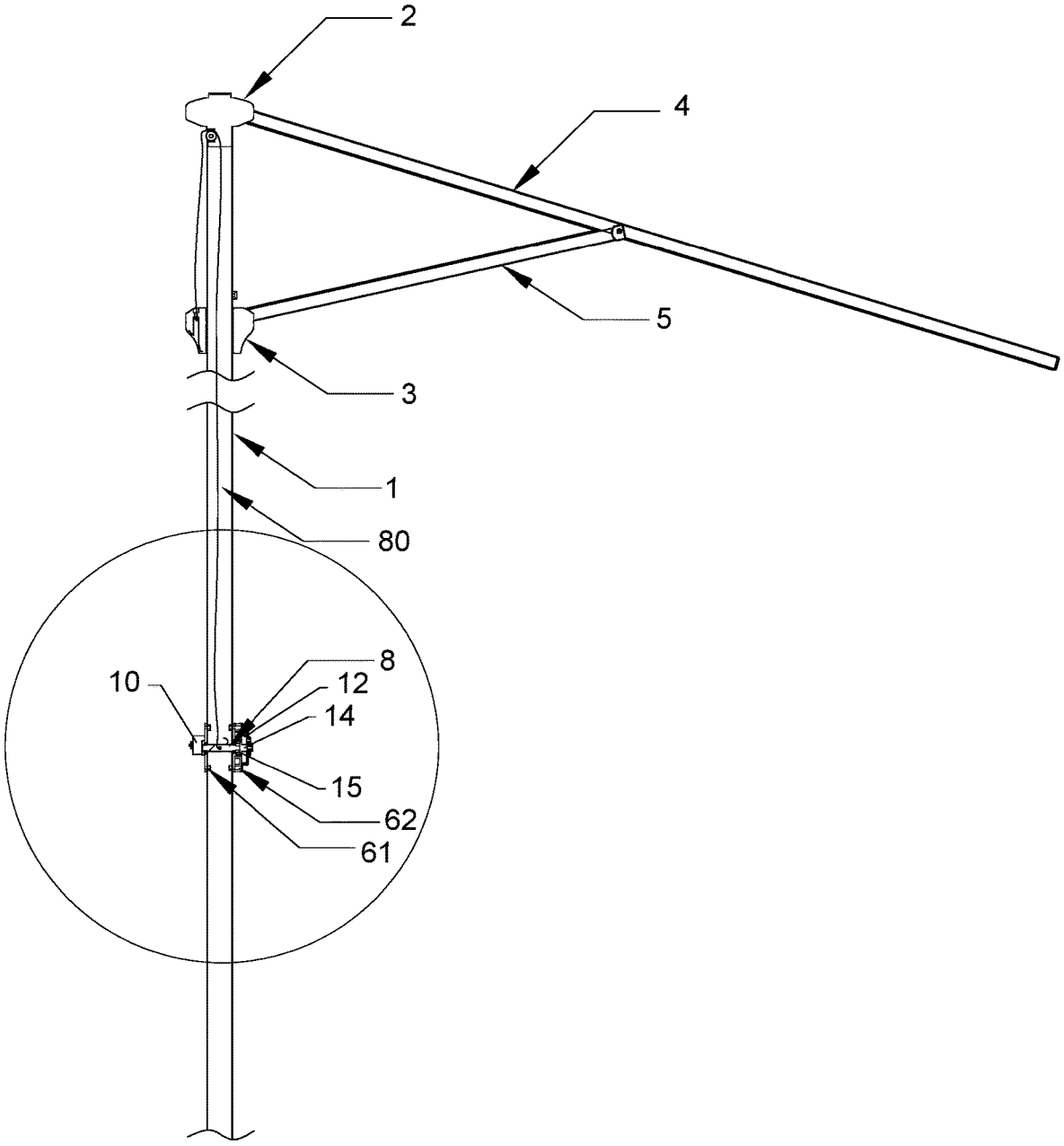
FIG. 2 is a partially sectional view of FIG. 1.
Figure 3:
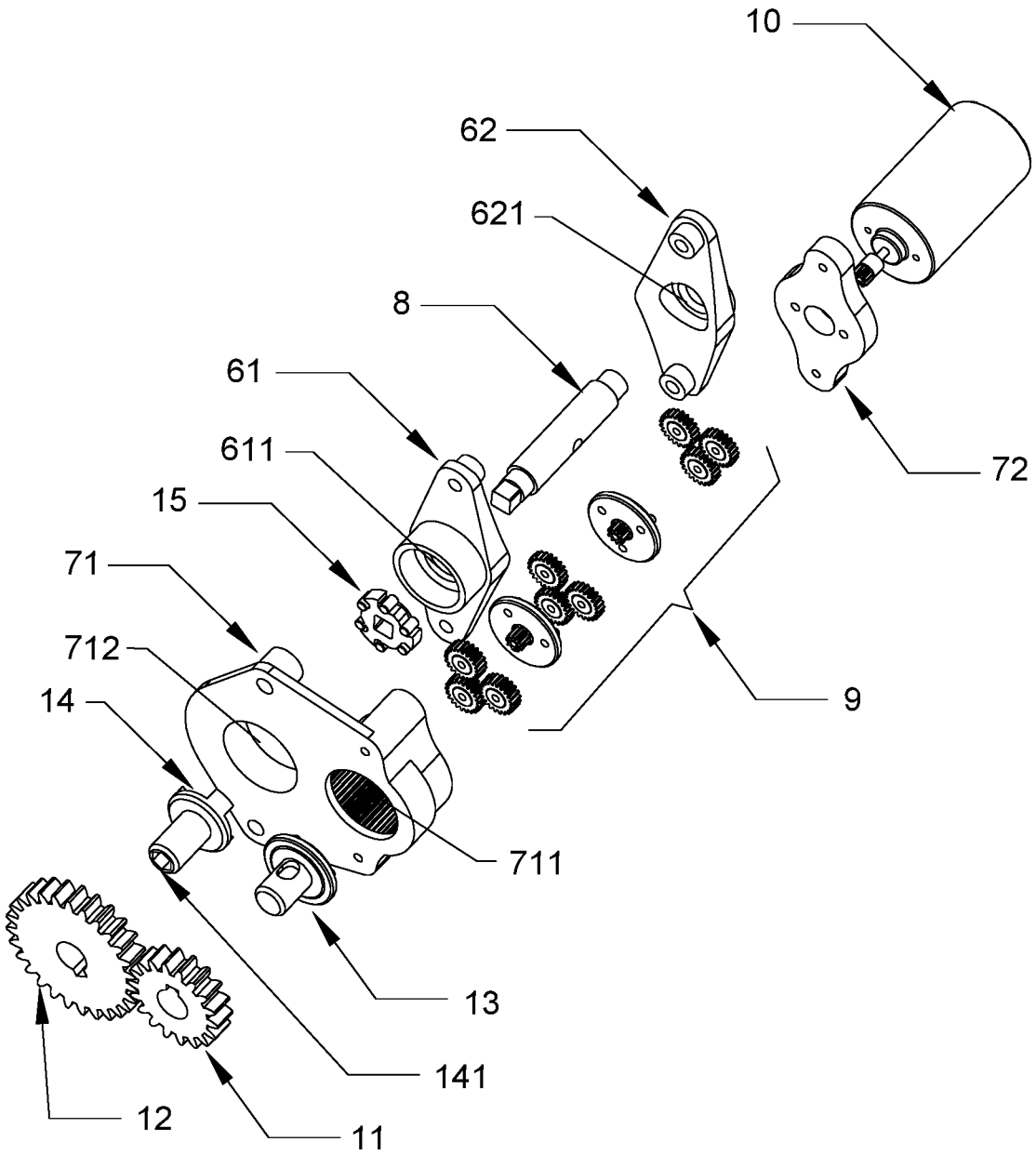
FIG. 3 is an exploded view of an electric folding/opening mechanism according to an embodiment of the present invention.
Figure 4:
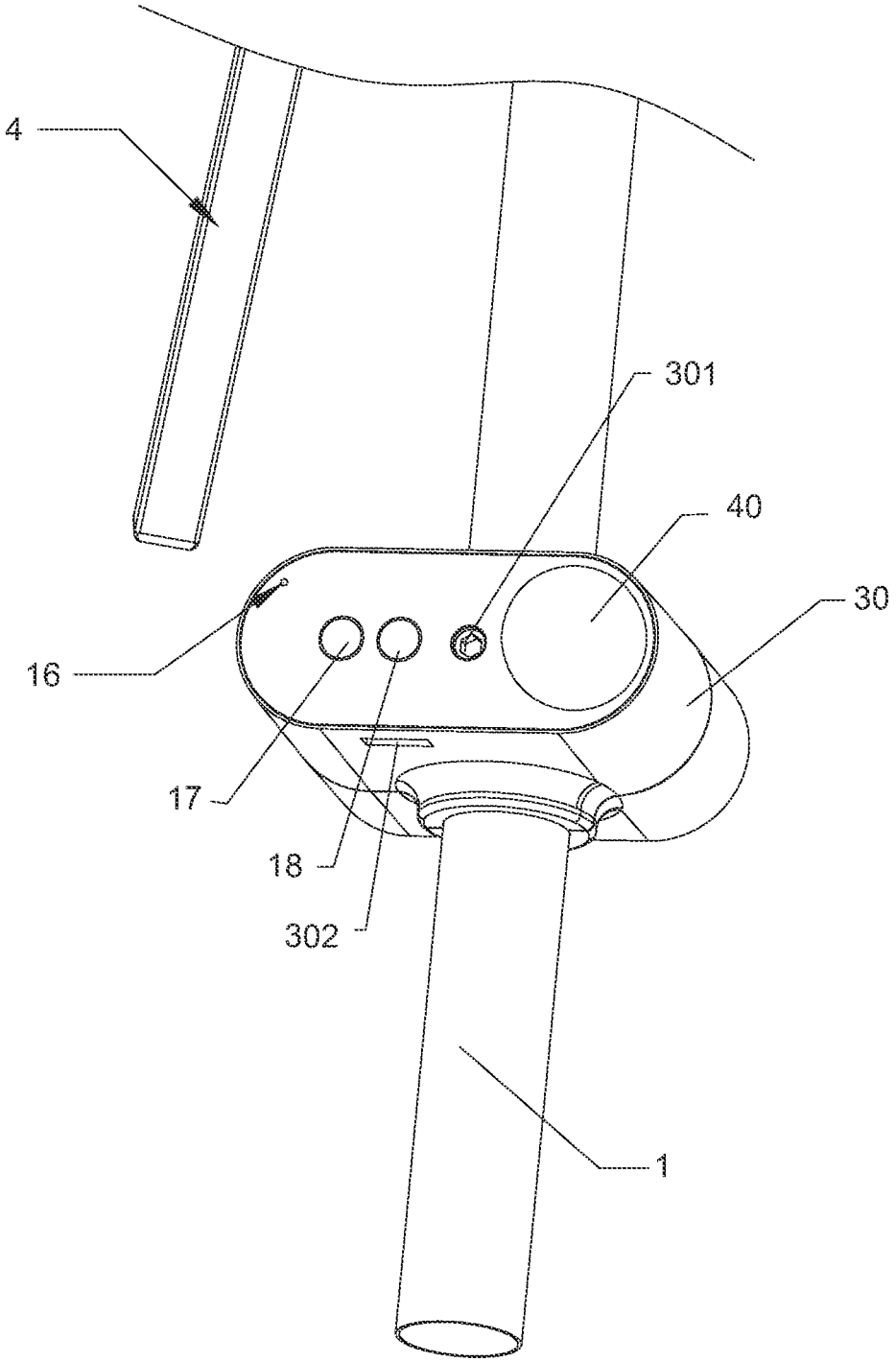
FIG. 4 is a perspective view of a housing on a column according to an embodiment of the present invention.

The present invention will be further described in detail below by embodiments with reference to the accompanying drawings.

As shown in FIGS. 1-4 and 6, an electrically-operated umbrella comprises a column being hollow; an upper tray 2 attached to top of the column; a lower tray 3 slidably fitted onto the column; a plurality of long rods 4 movably connected to the upper tray; a plurality of short rods 5 movably connected to the lower tray; and a rope 80 extending inside the column; wherein, the lower tray 3 is capable of sliding upward and downward along the column 1; each long rod 4 is rotatably hinged to the upper tray 2, and one end of each short rod 5 is hinged to the lower tray 3, while the other end of each short rod 5 is hinged to each long rod 4, forming an umbrella frame; a housing 30 is attached to a lower portion of the column 1; a rotatable rope shaft 8, a motor 10 for rotating the rope shaft 8, and a transmission mechanism are placed inside the housing 30; the rope shaft 8 is traversely disposed across the column 1 through a plurality of fixation seats 6; one end of the rope 80 is connected to the rope shaft 8, and the other end of the rope 80 runs upward through the upper tray 2 inside the column 1 and then runs downwardly to connect to the lower tray 3; a battery 40 and a circuit board are further disposed inside the housing 30, and a control button connected to the circuit board is disposed on the housing 30 to form a control circuit of the motor 10.

The specific structure will be described below. A through hole for receiving the rope shaft 8 is radially disposed in the lower portion of the column 1; the plurality of fixation seats 6 are composed of a left fixation seat 61 and a right fixation seat 62, which symmetrically disposed on left and right sides of the column 1, a plurality of connecting holes are formed on upper and lower sides of the fixation seats 6, and the plurality of fixation seats 6 are fixed to the middle column 1 through a plurality of connecting members; a circular hole 611 for receiving the left end of the rope shaft 8 is formed in the middle of the left fixation seat 61, and a shaft seat 621 for fixing and rotating the right end of the rope shaft 8 is formed in the middle of the right fixation seat 62; and the right end of the rope shaft 8 passes through the column 1 to be inserted into the shaft seat 621 of the right fixation seat 62, and a bearing convenient for rotating the rope shaft 8 is disposed in the shaft seat 621. The left end of the rope shaft 8 passes through the middle column 1 to be inserted into the circular hole 611 of the left fixation seat 61 and is connected to the transmission mechanism. The transmission mechanism comprises a transmission box 7, and a planetary gear set 9, a large spur gear 12 and a small spur gear 11 disposed in the transmission box 7. In this embodiment, the planetary gear set 9 employs a tertiary planetary gear transmission. Of course, the planetary gear set may not be limited to the tertiary planetary gear transmission. The transmission box 7 comprises a transmission box seat 71 and a transmission box cover 72; the transmission box seat 71 is disposed on the left side of the left fixation seat 61, one end of the transmission box seat 71 is fixed to the left fixation seat 61, and a mounting cylinder 711 for receiving the planetary gear set 9 is convexly disposed at the other end of the transmission box seat 71; the transmission box cover 72 is disposed at a right opening of the mounting cylinder 711 of the transmission box seat 71; the motor 10 is fixedly mounted on the transmission box cover 72, and a motor shaft passes through the transmission box cover 72 and is connected to the planetary gear set 9; and the other end of the planetary gear set 9 is connected to the small spur gear 11 through an output shaft 13. The number of planetary gear sets 9 can be increased or decreased a required to adjust torque to adapt to different canopy areas. The large spur gear 12 and the small spur gear 11 are respectively disposed on the left side of the transmission box seat 71, and the large spur gear 12 is meshed with the small spur gear 11; the output shaft 13 is disposed at a position on the transmission box seat 71 at the left opening of the mounting cylinder 711; a second circular hole 712 corresponding to the circular hole 611 in the middle of the left fixation seat 61 is formed on the transmission box seat 71, and a driven shaft 14 is disposed in the second circular hole 712; and one end of the driven shaft 14 is connected to the large spur gear 12, and the other end thereof passes through the transmission box seat 71 and is in transmission connection to the left end of the rope shaft 8 through a reverse clutch 15. A convex ring is formed at a position on the left side of the left fixation seat 61 corresponding to the circular hole 611 in the middle, the reverse clutch 15 is disposed in the convex ring, the left end of the rope shaft 8 is formed as a square shaft end, and a corresponding square hole is formed in the center of the reverse clutch 15. The reverse clutch 15 is provided to enable the large spur gear 12 to drive the rope shaft 8 to rotate but not enable the rope shaft 8 to drive the large spur gear 8 to rotate, thereby preventing the rope shaft 8 from reservedly rotating by the pull force of the rope 80. In this embodiment, the reverse clutch 15 employs a simple roller clutch; however, other one-way transmission clutches are also possible. A hexagonal groove 141 convenient for manually opening or folding the umbrella is disposed at the left end of the driven shaft 14, and an opening 301 corresponding to the hexagonal groove 141 is disposed on the corresponding side of the housing 30. In this way, when the battery level is insufficient, the rope shaft 8 can be manually driven by a hexagon wrench to open and fold the umbrella.

A positioning slot for receiving the battery 40 is disposed on the right side of the housing 30, the battery 40 is a rechargeable battery and is detachably inserted into the housing 30, and a USB interface 302 is further disposed on the housing 30, so that a mobile device can be charged. There are two control buttons, respectively an opening button 17 and a folding button 18, and the opening or folding of the umbrella is capable of being controlled by the control buttons or by a remote controller. A sensor 16 electrically connected to the circuit board is disposed on the housing 30; when the framework is folded to the bottom end and the sensor 16 detects the long rods 4 during folding, the circuit board stops supplying power and realizes automatic stopping after the umbrella is folded; and when the framework is completely opened, the resistance of the motor 10 by the rope 80 is increased, and the current in the motor 10 is increased, and the circuit board automatically stops supplying power after detecting the current and realizes automatic stopping after the umbrella is opened.

The specific operation will be described below.

When the umbrella should be opened, the opening button 17 is pressed down; the motor 10 is powered on to drive the planetary gear set 9 to rotate; the planetary gear seat 9 drives the output shaft 13 to rotate; the output shaft 13 drives the small spur gear 11 to rotate; the small spur gear 11 drives the large spur gear 12 to rotate; the large spur gear 12 drives the driven shaft 14 to rotate; the driven shaft 14 drives the reverse clutch 15 to rotate; and the reverse clutch 15 drives the rope shaft 8 to rotate. The rope shaft 8 winds the rope 80 during its rotation, and the rope 80 pulls the lower tray 3 to move up. After the lower tray 3 is moved to the top end, the rope 80 is tensioned, and the motor 10 cannot rotate. At this time, the current in the motor 10 is continuously increased. When the current in the motor 10 is increased to a preset value, power is automatically cut off to open the umbrella.

After the umbrella is opened, the lower tray 3 will tend to move down due to the wind force, gravity or the like, so as to compel the rope 80 to drive the rope shaft 8 to rotate reversely. At this time, the rope shaft 8 triggers the reverse clutch 15 so that the rope shaft 8 cannot rotate. Thus, the lower tray 3 is fixed.

When the umbrella should be folded, the folding button 18 is pressed, the motor 10 is rotated reversely to drive the lower tray 3 to move down, and the long rods 4 are folded to approach to the housing 30. When the long rods 4 approach to the sensor 16, the circuit board stops supplying power, and the motor 10 is automatically powered off and stops rotating, so that the umbrella is folded.

When the battery level is insufficient, a manual operation can be performed by a hexagon wrench through the hexagonal groove 141 at the tail end of the driven shaft 14 to open or fold the umbrella. The user can supply power to a mobile device by using the USB interface 302 on the bottom of the housing 30. When the battery level is insufficient, the battery 40 can be taken out for charging.

Embodiment 2

Figure 5:
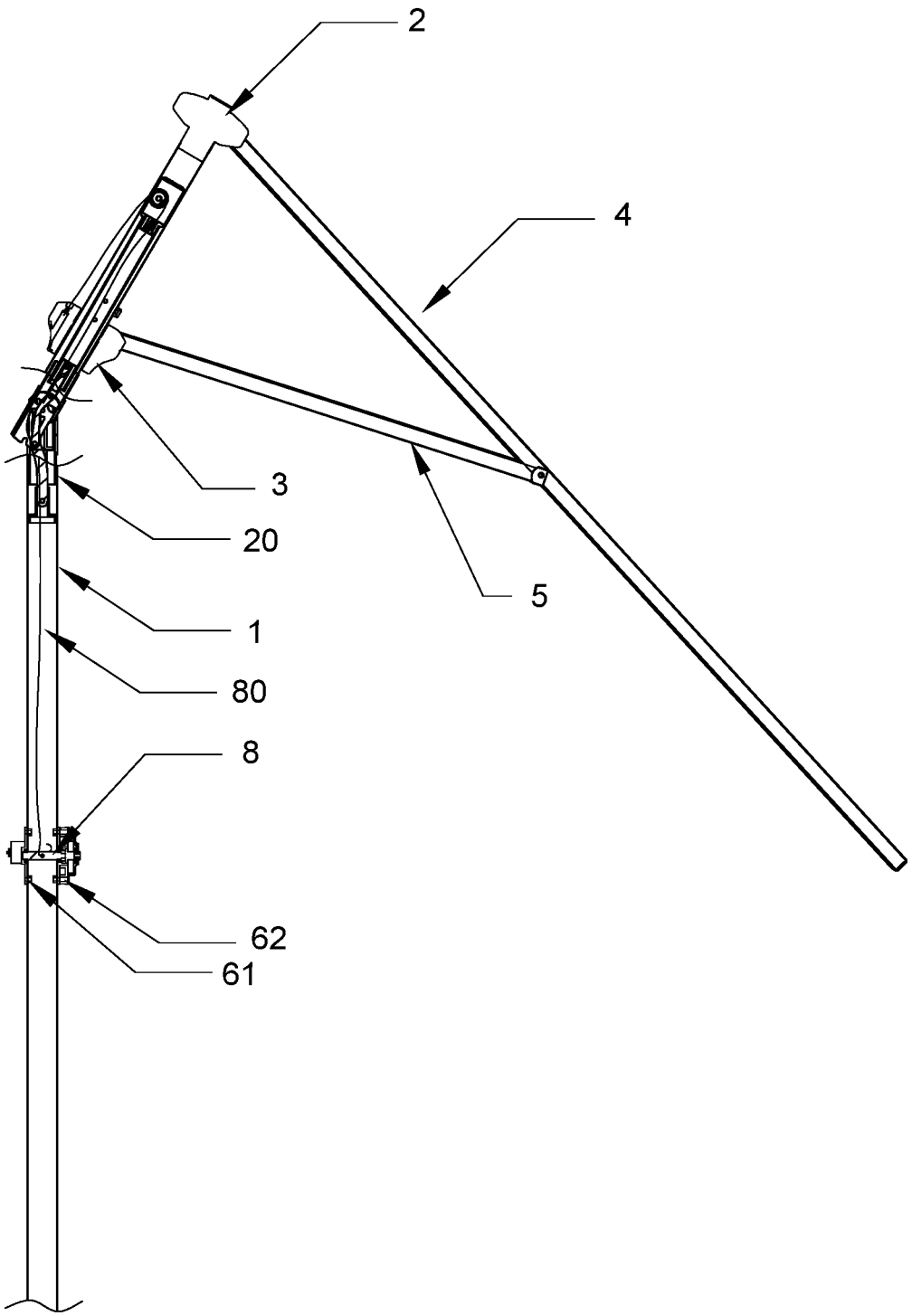
FIG. 5 is a partially sectional view after an automatic bending mechanism is additionally mounted according to Embodiment 2 of the present invention.
Figure 6:
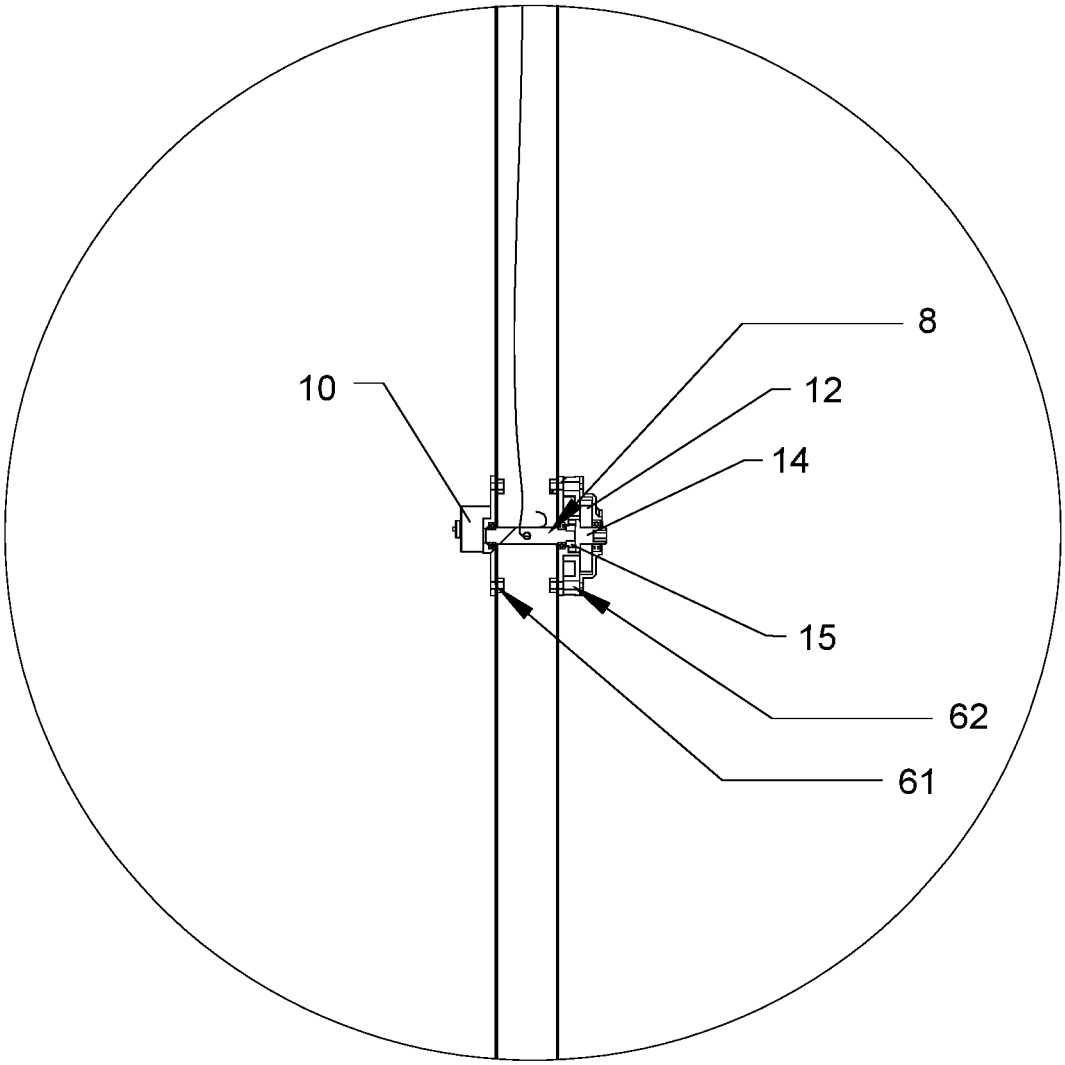
FIG. 6 is a partially enlarged view of FIG. 2.

As shown in FIG. 5, an electrically-operated umbrella comprises an upper tray 2, a lower tray 3, long rods 4, short rods 5 and a column 1. A rope shaft 8, a left fixation seat 61, a right fixation seat 62, a transmission mechanism, a motor and other components are mounted on the column. The umbrella of this embodiment differs from that of Embodiment 1 in that, an automatic bending mechanism 20 is additionally mounted on the column 1. The structure and principle of the automatic bending mechanism 20 are the same as those described in U.S. Pat. No. 8,272,391B2/LZ201020556192.1/Nr.202010011240.0, and will not be specifically described here. The rope 80 passes through the automatic bending mechanism 20 and is connected to the lower tray 3; and when the rotation of the rope shaft 8 drives the lower tray 3 to move up to the top, the rope shaft 8 is continuously rotated to drive the automatic bending mechanism 20 to bend.

The foregoing description merely shows the preferred implementations of the present invention. It should be pointed out that, to one person of ordinary skill in the art, various improvements and modifications may be made without departing from the technical principle of the present invention, and these improvements and modifications shall be deemed as falling into the protection scope of the present invention.

The invention claimed is:

1. An electrically-operated umbrella, comprising:

a column, being hollow;

an upper tray attached to a top of the column;

a lower tray slidably fitted onto the column;

a plurality of ribs movably connected to the upper tray;

a plurality of stretchers movably connected to the lower tray; and a rope extending inside the column;

wherein, the lower tray is capable of sliding upward and downward along the column;

each rib is rotatably hinged to the upper tray, and one end of each stretcher is hinged to the lower tray, while an opposite end of each stretcher is hinged to each rib, forming an umbrella frame;

a housing is attached to a lower portion of the column;

a through hole for receiving the rope shaft is radially disposed in the lower portion of the column;

a rotatable rope shaft, a motor for rotating the rope shaft, and a transmission mechanism are placed inside the housing;

the rope shaft is traversely disposed across the column through a plurality of fixation seats;

one end of the rope is connected to the rope shaft, and the other end of the rope runs upward through the upper tray inside the column and then runs downwardly to connect to the lower tray;

a battery and a circuit board are further disposed inside the housing, and a control button connected to the circuit board is disposed on the housing to form a control circuit of the motor;

the plurality of fixation seats is composed of a left fixation seat and a right fixation seat, which are symmetrically disposed on left and right sides of the column, a plurality of connecting holes is formed on upper and lower sides of the fixation seats, and the plurality of fixation seats is fixed to the column through a plurality of connecting members;

a circular hole for receiving the left end of the rope shaft is formed in the middle of the left fixation seat, and a shaft seat for fixing and rotating the right end of the rope shaft is formed in the middle of the right fixation seat;

the right end of the rope shaft passes through the column to be inserted into the shaft seat of the right fixation seat, while the left end of the rope shaft passes through the middle column to be inserted into the circular hole of the left fixation seat and is connected to the transmission mechanism;

the transmission mechanism comprises a transmission box, and a planetary pear set, a first spur gear and a second spur gear disposed in the transmission box, the second spur gear being smaller than the first spur gear;

the transmission box comprises a transmission box seat and a transmission box cover;

the transmission box seat is disposed on a left side of the left fixation seat, a first end of the transmission box seat is fixed to the left fixation seat, and a mounting cylinder for receiving the planetary gear set is convexly disposed at a second end of the transmission box seat;

the transmission box cover is disposed at a right opening of the mounting cylinder of the transmission box seat;

the motor is fixedly mounted on the transmission box cover, and a motor shaft passes through the transmission box cover and is connected to the planetary gear set; and an end of the planetary gear set is connected to the second spur gear through an output shaft.

2. The umbrella of claim 1, wherein the first spur gear and the second spur gear are respectively disposed on the left side of the transmission box seat, and the first spur gear meshes with the second spur gear;

the output shaft is disposed at a position on the transmission box seat at the left opening of the mounting cylinder;

a second circular hole corresponding to the circular hole in the middle of the left fixation seat is formed on the transmission box seat, and a driven shaft is disposed in the second circular hole; and one end of the driven shaft is connected to the first spur gear, and the other end thereof passes through the transmission box seat and is in transmission connection to the left end of the rope shaft through a reverse clutch.

3. The umbrella of claim 2, wherein a convex ring is formed at a position on the left side of the left fixation seat corresponding to the circular hole in the middle, the reverse clutch is disposed in the convex ring, the left end of the rope shaft is formed as a square shaft end, and a corresponding square hole is formed in the center of the reverse clutch.

4. The umbrella of claim 3, wherein a hexagonal groove convenient for manually opening or folding the umbrella is disposed at the left end of the driven shaft, and an opening corresponding to the hexagonal groove is disposed on the corresponding side of the housing.

5. The umbrella of claim 1, wherein a positioning slot for receiving the battery is disposed on the right side of the housing, the battery is a rechargeable battery and is detachably inserted into the housing, and a USB interface is further disposed on the housing.

6. The umbrella of claim 1, wherein there are two control buttons, respectively an opening button and a folding button, and the opening or folding of the umbrella is capable of being controlled by the control buttons or by a remote controller.

7. The umbrella of claim 1, wherein a sensor electrically connected to the circuit board is disposed on the housing;

when the umbrella frame is folded closed and the sensor detects the ribs during folding, the circuit board stops supplying power after the umbrella is folded; and when the umbrella frame is completely opened, resistance of the motor by the rope is increased, and current in the motor is increased, and the circuit board automatically stops supplying power after detecting the current and after the umbrella is opened.

8. The umbrella of claim 1, wherein an automatic bending mechanism is additionally mounted on the column;

the rope passes through the automatic bending mechanism and is connected to the lower tray; and when the rotation of the rope shaft drives the lower tray to move up to the top, the rope shaft is continuously rotated to drive the automatic bending mechanism to bend.

* * * * *